US005784831A

United States Patent [19]

Licking

[11] Patent Number: 5,784,831

[45] **Date of Patent: *Jul. 28, 1998**

[54] WINDOW PROPELLING SYSTEM

[76] Inventor: Michael A. Licking, 1129 Boulevard, Sturgis, S. Dak. 57785

[ * ] Notice: This patent issued on a continued prosecution application filed under 37 CFR 1.53(d), and is subject to the twenty year patent term provisions of 35 U.S.C. 154(a)(2).

[21] Appl. No.: 786,622

[22] Filed: Jan. 21, 1997

Related U.S. Application Data

[63] Continuation-in-part of Ser. No. 303,408, Sep. 9, 1994, Pat. No. 5,595,026.

[51] Int. Cl.[6] ..... E05B 65/10

[52] U.S. Cl. ..... 49/141; 49/139; 49/360

[58] Field of Search ..... 49/139, 140, 141, 49/137, 360

[56] References Cited

U.S. PATENT DOCUMENTS

| | | | |
|---|---|---|---|
| 378,882 | 3/1888 | Glasscock . | |
| 496,997 | 5/1893 | Chisholm . | |
| 509,106 | 11/1893 | Shannon . | |
| 598,294 | 2/1898 | Robbins . | |
| 720,399 | 2/1903 | Brewer . | |
| 722,110 | 3/1903 | Johnston . | |
| 737,547 | 8/1903 | Young . | |
| 762,692 | 6/1904 | Davis et al. . | |
| 780,249 | 1/1905 | Withey . | |
| 1,002,030 | 8/1911 | Brown . | |
| 1,047,143 | 12/1912 | Atwood . | |
| 1,859,364 | 5/1932 | Haskell . | |
| 1,919,671 | 7/1933 | Shetzline . | |
| 2,132,325 | 10/1938 | Soldatti . | |
| 2,361,040 | 10/1944 | Larsen . | |
| 3,755,967 | 9/1973 | Nourse | 49/360 |
| 3,802,123 | 4/1974 | Frey et al. | 49/141 |
| 4,249,345 | 2/1981 | Littleton | 49/56 |
| 4,282,685 | 8/1981 | Williams et al. | 49/141 |
| 4,476,678 | 10/1984 | Hall | 491/360 X |
| 4,488,621 | 12/1984 | Schiewe | 187/70 |
| 4,735,292 | 4/1988 | Munz | 491/360 X |
| 5,549,180 | 8/1996 | Hansen | 187/347 |
| 5,595,026 | 1/1997 | Licking et al. | 491/360 X |

*Primary Examiner*—Jerry Redman
*Attorney, Agent, or Firm*—Kinney & Lange, P.A.

[57] ABSTRACT

A window propelling system for rapidly opening a window or door. The window propelling system is designed for installation with existing units and preferably includes a lift assembly, a cylinder assembly, a hammer assembly, a firing assembly and a secondary triggering assembly. The lift assembly includes a lift cable attached at opposite ends to the window or door. The cylinder assembly includes a piston cable which drives the lift cable during emergency opening. The cylinder assembly, in turn, is actuated by the firing assembly in response to operation of the hammer assembly. The hammer assembly is released by either an interior trigger or the secondary trigger assembly.

2 Claims, 13 Drawing Sheets

WINDOW PROPELLING SYSTEM

This is a continuation-in-part of application Ser. No. 08/303,408, filed on Sept. 9, 1994 now U.S. Pat. No. 5,595,026.

BACKGROUND OF THE INVENTION

The present invention relates to emergency window or door opening systems. In particular, the present invention is a window propelling system for quickly opening a window or door. The window propelling system may be activated in situations when, for instance, the user is incapable of, or prevented from, opening the window manually. The window propelling system may be operated without electrical power.

Emergency door and window opening systems are known. For example, Fry et al. U.S. Pat. No. 3,802,123 discloses a system for opening a sliding door automatically in the absence of electricity. The system includes a compressed air canister, an air line, an assembly including a cylinder, a piston and a rod, and a door stop. A solenoid triggering device keeps the compressed air canister closed while electricity is available. If the electricity supply fails, the solenoid allows compressed air to escape from the canister. The air then flows through the air lines and into the cylinder where it propels the piston and rod horizontally, causing the rod to engage the door stop and force the door open. The Fry et al. system is specifically designed to open doors in a horizontal fashion. The Fry et al. system applies the moving force at a single point, possibly damaging the door. Finally, the Fry et al. system fails to consider or provide for manual opening of the door.

Similarly, Williams et al. U.S. Pat. No. 4,282,685 discloses a "trap door" construction in which the bottom frame of the window collapses when a latch is pulled, causing the window to fall into a cavity of the wall. The window is designed to remain in a fixed, closed position under normal conditions; it can only be opened by use of the latch. Hence, the Williams et al. design does not allow for traditional manual opening of the window.

Finally, Shetzline U.S. Pat. No. 1,919,671 provides an automobile window opening system. The system is powered by the partial vacuum developed within the intake manifold of the automobile engine. A single cable is attached at one end to a piston, and to a bottom portion of the window at the other end. A pawl/racket assembly controls positioning of the piston. The window can only be moved by forced movement of the cylinder. Further, the cable is attached to the window at a single point. The Shetzline system does not allow for manual movement of the window.

A continuing need exists for a window propelling system that provides for quick, emergency opening of a window. The prior art does not cover an integrated assembly which is easy to install, does not require electrical power and allows the window to be opened manually.

SUMMARY OF THE INVENTION

The present invention provides a window or door propelling system for opening a window or door. A moveable window unit housed within a frame can be caused to open upon occurrence of an initiating event, without the use of manual force, by the window propelling system.

In one alternative embodiment, the window propelling system is configured to open a vertically moving window. The window propelling system includes a lift assembly in communication with a cylinder assembly that is connected by a transport line to a forced fluid supply source. The lift assembly includes a piston cable, a pulley assembly and a lift cable. The piston cable communicates with the cylinder assembly such that the piston cable movably extends from a cylinder portion of the cylinder assembly. The pulley assembly is also connected to the piston cable and transposes a force from the piston cable to the lift cable. Finally, the lift cable is in communication with the pulley assembly and is configured to apply a lifting force to the window. When a user desires to activate the window propelling system, he or she presses a button or switch associated with the forced fluid supply source, which releases pressurized fluid into the transport line. The fluid flows through the transport line and into the cylinder assembly. In response, the cylinder assembly applies a force to the piston cable. This action, in turn, moves the attached pulley assembly and lift cable to open the window. A similar arrangement for a door assembly is also possible. Notably, the piston cable communicates with the piston and cylinder assembly such that manual movement of the window is allowed.

The window propelling system may also include a window unlock assembly for opening a lock associated with the window. Alternative embodiments of a window propelling system also include a firing assembly having a puncture indicator, a hammer assembly and a secondary trigger assembly.

DETAILED DESCRIPTION OF THE PREFERRED EMBODIMENTS

Figure 1A:
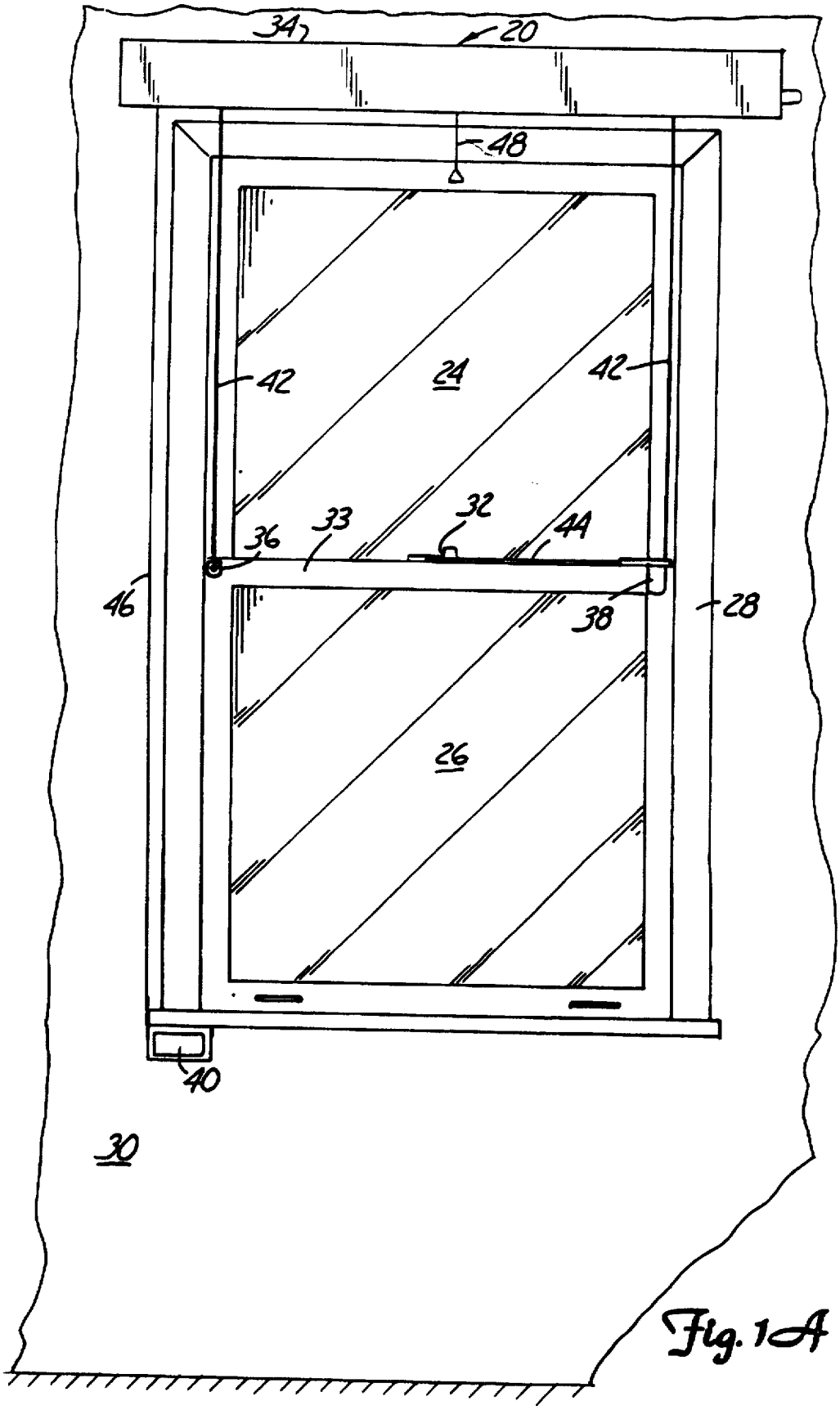
FIG. 1A is a front view of a window propelling system of the present invention attached to a vertically moving window.

FIG. 1A depicts visible portions of a window propelling system 20 of the present invention. The present invention will be described in relation to a window assembly 22 having two separate window units, an upper window 24 and a lower window 26, installed within a frame 28. The upper window 24 is fixed within the frame 28 while the lower window 26 slides vertically within the frame 28. The frame 28 is mounted within a wall 30, shown partially in FIG. 1A. The lower window 26 includes a lock 32 attached to an upper sash 33 for locking the lower window 26 with respect to the upper window 24 and within the frame 28. This type of window assembly is sometimes referred to as a double hung window. However, the present invention also applies to casement windows, sliding doors, and similar assemblies.

Generally speaking, the window propelling system 20 includes an assembly housing 34, a harness 36, a window unlock assembly 38, a trigger 40, a lift cable 42, a window unlock cable 44, an interior triggering cable 46 and a cocking lanyard 48. The assembly housing 34 and the trigger 40 are attached to a surface of the wall 30 above and adjacent the window assembly 22 inside of a room. The harness 36 and the window unlock assembly 38 are fixed at opposite sides of the upper sash 33 of the lower window 26. The lift cable 42 is attached at one end to the harness 36 and at the other end to the window unlock assembly 38. Further, the lift cable 42 passes through the assembly housing 34 where it interacts with various components (not shown in FIG. 1A). The lift cable 42 is connected to a window unlock cable 44 at the window unlock assembly 38. The window unlock cable 44, in turn, is attached to the window lock 32. The triggering cable 46 connects the trigger 40 to a firing assembly (not shown in FIG. 1A) maintained within the housing 34. Finally, the cocking lanyard 48 extends from the assembly housing 34.

Figure 1B:
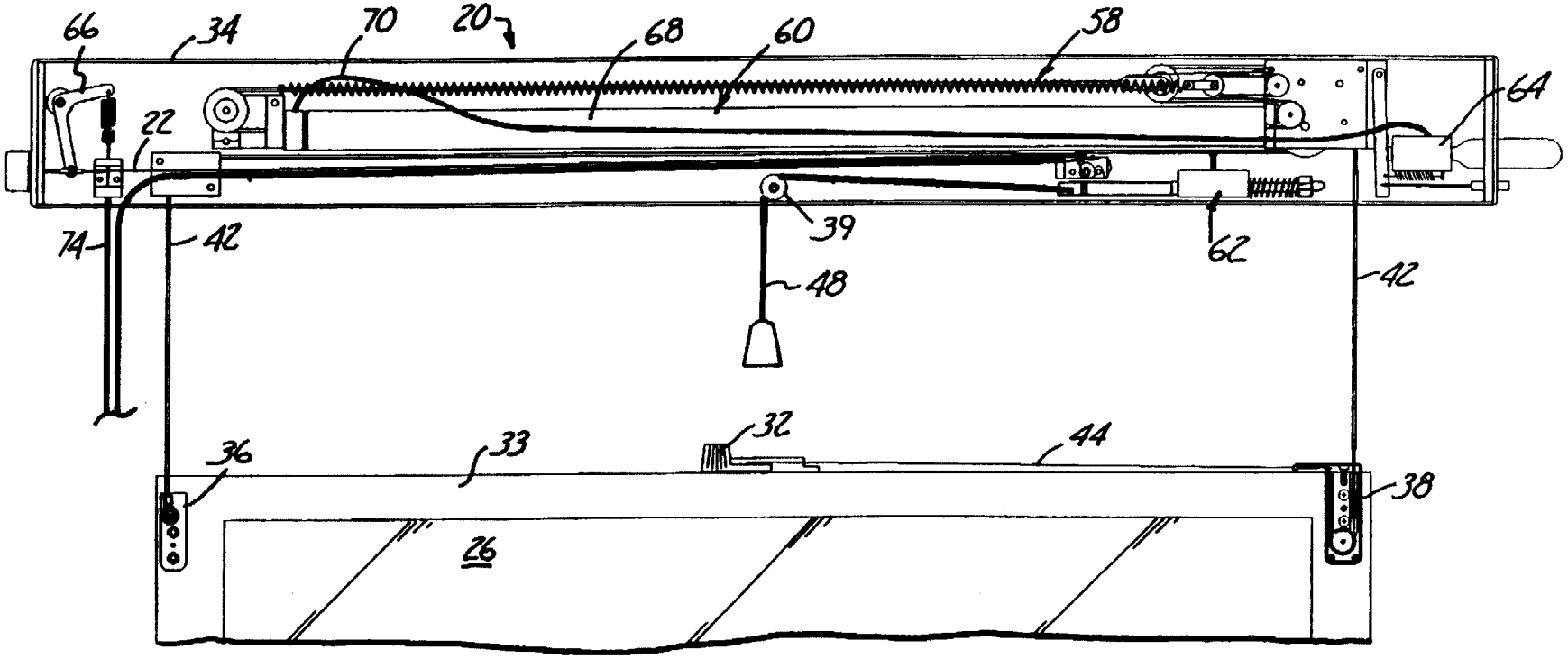
FIG. 1B is an enlarged, front view of the window propelling system with a front cover removed.

FIG. 1B provides greater details on components of the window propelling system 20 maintained within the assembly housing 34. In particular, for purposes of clarity, FIG. 1B shows the assembly housing 34 with its cover removed, along with the upper sash 33 of the lower window 26. Within the housing 34, the window propelling system 20 includes a lift assembly 58, a cylinder assembly 60, a hammer assembly 62, a firing assembly 64 and a secondary trigger assembly 66.

The lift assembly 58 controls movement of the lift cable 42 and includes the harness 36 and the window unlock assembly 38. The lift cable 42 extends from the lift assembly and is attached at opposite ends to the harness 36 and the window unlock assembly 38, respectively.

The cylinder assembly 60 includes a cylinder 68 which communicates with the lift assembly 58. Further, the cylinder assembly 60 is connected to the firing assembly 64 by a transmission line or tube 70.

The hammer assembly 62 communicates with the firing assembly 64, such that release of the hammer assembly 62 activates the firing assembly 64. The hammer assembly 62 is attached to the cocking lanyard 48, the interior triggering cable 46 and a secondary triggering cable 72. The cocking lanyard 48 is used to set the hammer assembly 62. The hammer assembly 62 is connected to the interior trigger 40 (FIG. 1A) by the interior triggering cable 46 which extends from the assembly housing 34. Finally, the hammer assembly 62 is connected to the secondary trigger assembly 66 by the secondary triggering cable 72.

The firing assembly 64 provides pressurized fluid to the cylinder assembly 60 through the transmission line 70. The firing assembly is activated by the hammer assembly 62.

The secondary trigger assembly 66 is attached to an exterior trigger (not shown) by an exterior initiating cable 74 that extends from the assembly housing 34.

Each of the various assemblies referred to above are described in greater detail below. Generally speaking, however, the window propelling system 20 operates as follows. The cocking lanyard 48 is used to set or "cock" the hammer assembly 62. The hammer assembly 62 is released by either the interior trigger 40 (FIG. 1A) via the interior triggering cable 46, or the secondary trigger assembly 66 via the secondary triggering cable 72. For example, upon activation of the interior trigger 40 (FIG. 1A), the interior triggering cable 46 releases the hammer assembly 62. The hammer assembly 62, in turn, activates the firing assembly 64. The firing assembly 64 supplies pressurized fluid to the cylinder assembly 60 via the transmission line 70. The cylinder assembly 60 propels the lift assembly 58 such that a lifting force is placed on the lift cable 42. This lifting force is first transferred by the window unlock assembly 38 to the window unlock cable 44 which unlocks the lock 32. Once unlocked, the lower window 26 is lifted upward by the lift cable 42 via forces placed at the harness 36 and the window unlock assembly 38. Alternatively, the secondary trigger assembly 66 can be caused to release the hammer assembly 62, resulting in the lower window 26 raising upwards, as previously described.

Window Unlock Assembly 38 and Lift Assembly 58

Figure 2:
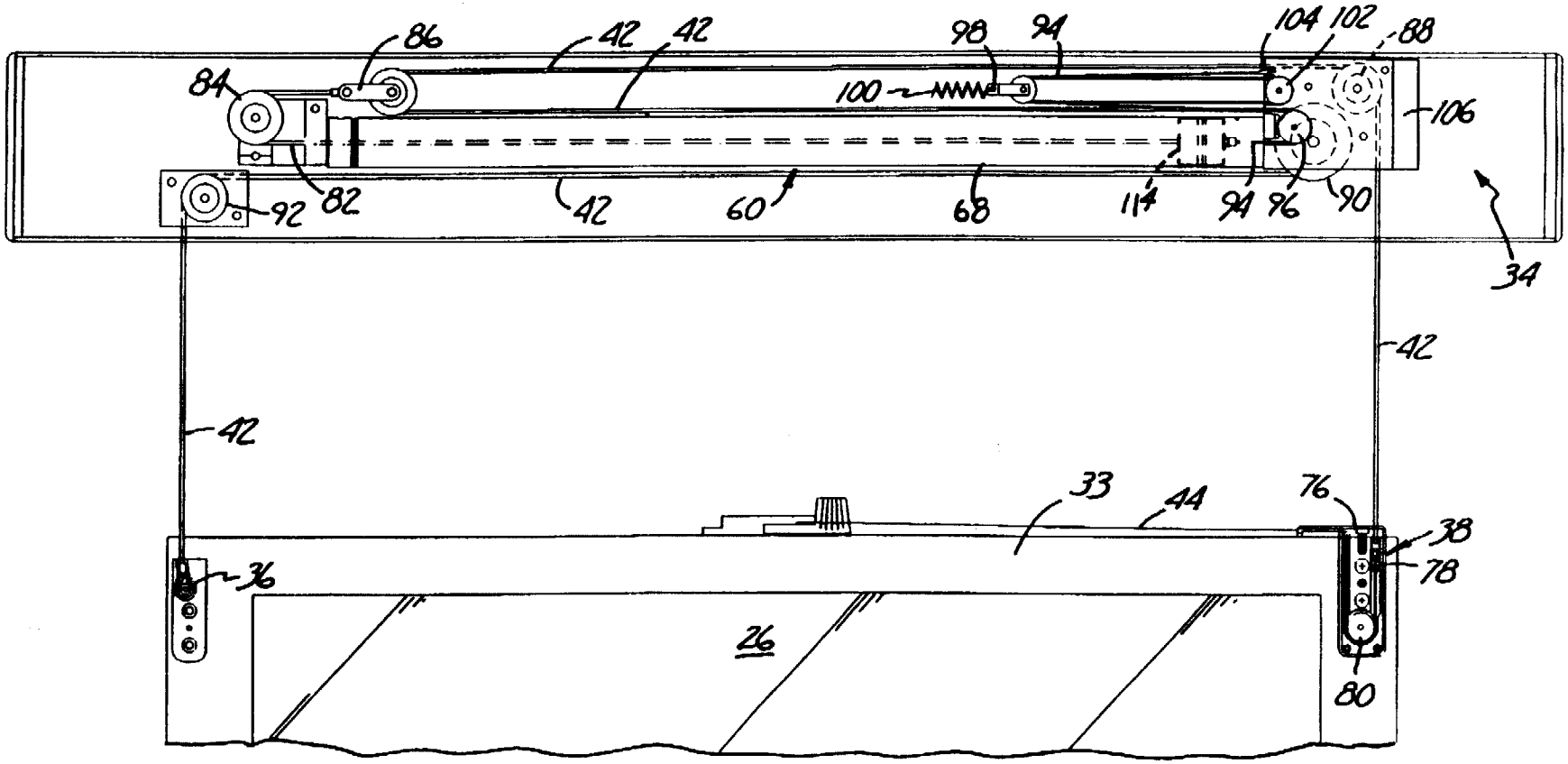
FIG. 2 is an enlarged, front view of the lift assembly and the cylinder assembly of the window propelling system.

FIG. 2 shows the window unlock assembly 38 and the lift assembly 58 in greater detail. For ease of illustration, the cylinder assembly 60 is shown generally and the hammer assembly 62, the firing assembly 64 and the secondary trigger assembly 66 are not shown. Further, the housing 34 is shown with its cover removed.

The window unlock assembly 38 includes a frame 76, a slider block 78, a direction pulley 80 and the window unlock cable 44. The slider block 78 is selectively attached within the frame 76. The direction pulley 80 is rotatably attached to the frame 76. The lift cable 42 and the window unlock cable 44 are attached to, and extend from, opposite sides of the slider block 78. The window unlock cable 44 extends from the slider block 78, around the directional pulley 80, and is guided out of the frame 76. Upon final assembly, the frame 76 is attached to the upper sash 33 of the lower window 26. The window unlock cable 44 is attached to the lock 32.

During use, a lifting force is placed on the lift cable 42. This lifting force is then transposed on to the slider block 78. The slider block 78 moves upward within the frame 76, imparting a similar force on the attached window unlock cable 44. The window unlock cable 44 forces the lock 32 open. Further movement of the slider block 78 is prevented by the frame 76. In other words, once the lock 32 has been unlocked, the slider block 78 is "locked" with respect to the frame 78 such that further movement of the lift cable 42 is placed directly on the lower window 26.

The lift assembly 58 includes a piston cable 82, a nose pulley 84, a lift cable equalizer pulley 86, the lift cable 42, a first lift cable-direction pulley 88, a second lift cable-direction pulley 90, a third lift cable-direction pulley 92, a takeup cable 94, a takeup cable-direction pulley 96, a free takeup pulley block 98, a takeup spring 100 (shown partially in FIG. 2 for purposes of illustration), a fixed takeup pulley block 102 and a grommet 104. The nose pulley 84, the first lift cable-direction pulley 88, the second lift cable-direction pulley 90 and the third lift cable-direction pulley 92 are rotatably mounted to the assembly housing 34. As shown in greater detail below, the takeup cable-direction pulley 96, the fixed takeup pulley block 102 and the grommet 104 are attached to a frame 106 which is mounted to the housing 34, clearing the first lift cable-direction pulley 88 and the second lift cable-direction pulley 90.

The lift cable 42 is attached at one end to the harness 36. From this point, the lift cable 42 is directed over the third cable-direction pulley 92, around the second lift cable-direction pulley 90, around the lift cable equalizer pulley 86, over the first lift cable-direction pulley 88 and is attached within the window unlock assembly 38, as previously described.

The piston cable 82 extends from a rear end of the cylinder assembly 60. Generally, the cylinder assembly 60 includes a cylinder 68 having a piston 114. The piston cable 82 passes into the cylinder 68, through the piston 114, and is attached to the takeup cable 94. Notably, as described in greater detail below, the piston cable 82 is allowed to move back and forth within the cylinder 68, including the piston 114. The piston cable 82 extends from the cylinder 68, around the nose pulley 84 and is attached to the lift cable equalizer pulley 86. The lift cable equalizer pulley 86 is not attached to the housing 34.

The takeup cable 94 extends from the cylinder assembly 60, opposite the piston cable 82. As shown more clearly in FIG. 3, the takeup cable 94 extends from the cylinder 68, around the takeup cable-direction pulley 96, to the free takeup pulley block 98. A first sheave (not shown) of the free takeup pulley block 98 directs the takeup cable 94 to the fixed takeup pulley block 102. The fixed takeup pulley block 102, in turn, directs the takeup cable 94 to a second sheave (not shown) in the free takeup pulley block 98 which then directs the takeup cable 94 to the frame 106 where it is attached by the grommet 104. The takeup spring 100 is attached to the free takeup pulley block 98 and to a base portion of the cylinder assembly 60, shown in greater detail in FIG. 4A. A shoulder 112 maintains the cable takeup direction pulley 96. The configuration set forth in FIG. 3 preferably provides a 6:1 ratio of movement of the takeup cable 94 with respect to the free takeup pulley block 98. In other words, with reference to the orientation of FIG. 3, a six inch movement of the takeup cable 94 (within the cylinder 68) to the right results in a one inch movement of the free takeup pulley block 98 to the left.

The takeup spring 100 maintains the takeup cable 94 taut between the free takeup pulley block 98 and the fixed takeup pulley block 102. Thus, the takeup spring 100 is tensioned to pull the free takeup pulley block 98 away from the fixed takeup pulley block 102.

The preferred embodiment of the lift assembly 58 includes three cables; the lift cable 42, the piston cable 82 and the takeup cable 94. The lift cable is tensioned by the lower window 26 and the lift cable equalizer pulley 86. Movement of the lift cable equalizer pulley 86 moves the lower window 26. The piston cable 82 is tensioned by the lift cable equalizer pulley 86 and the takeup cable 94. The takeup cable 94 is tensioned by the piston cable 82 and the lift spring 100 (via motivation of the free takeup pulley block 98).

Figure 3:
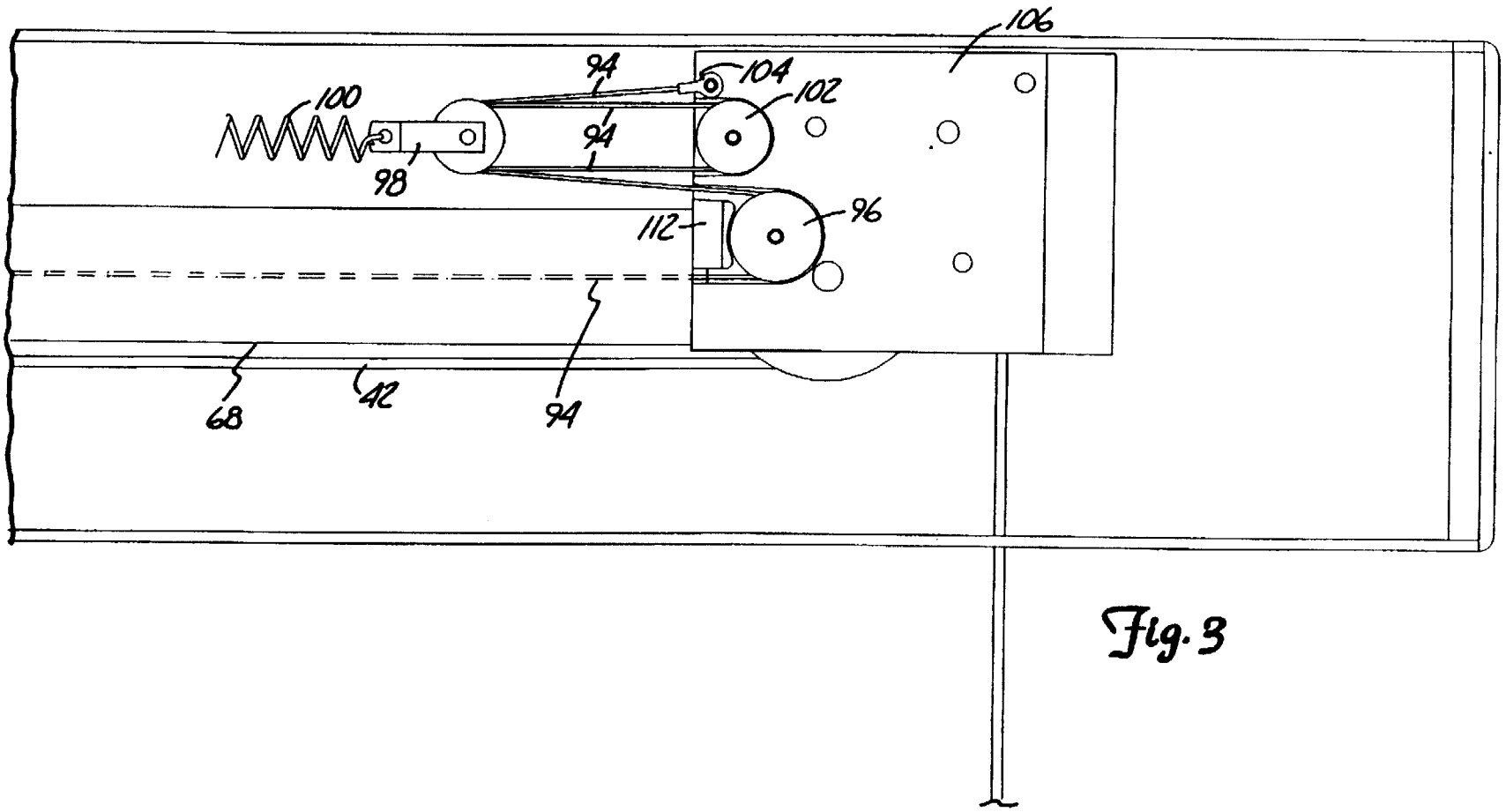
FIG. 3 is an enlarged, front view of a portion of the lift assembly of the window propelling system.

With reference to FIGS. 2 and 3, the lift assembly 58 provides for raising or lowering of the lower window 26. As a point of reference, the lift assembly 58 is shown in the raised position in FIG. 2. Raising of the lower window 26, either forced or manual, requires a leftward movement of the lift cable equalizer pulley 86. There are two modes of lifting; emergency, forced lifting or traditional, manual lifting. Either mode requires movement of the ends of the lift cable 42 upward. During a forced lifting mode, the lift cable equalizer pulley 86 is forced to the left via a pulling force from the piston cable 82 imparted by the cylinder assembly 60. The lift cable equalizer pulley 86 applies a retracting force to the lift cable 42 which motivates the lower window 26 open. Notably, the lift cable equalizer pulley 86 ensures that a uniform force is applied at either end of the lift cable 42, which is attached at opposite sides of the lower window 26.

As shown in FIG. 2, the forced lifting mode drives the piston cable 82 rightward within the cylinder assembly 60. This same action also drives the takeup cable 94 rightward within the cylinder assembly 60. The free takeup pulley block 98 and the fixed takeup pulley block 102 act to keep the takeup cable 94 taut during this motion. More particularly, the takeup spring 100 is tensioned, motivating the free takeup pulley block 98 away from the fixed takeup pulley block 102. As the takeup cable 94 is forced rightward within the cylinder assembly 60, the free takeup pulley block 98, via the takeup spring 100, moves leftward, tensioning the takeup cable 94 and preventing slack. The preferred 6:1 ratio ensures that the takeup cable 94 is constantly tensioned and does not impede raising of the lower window 26.

Alternatively, during manual lifting of the lower window 26, the takeup spring 100 prevents slack in the lift cable 42. More particularly, as the lower window 26 is manually raised, the lift cable 42 is retracted (upwards in FIG. 2). Once again, the piston cable 82 is attached to the takeup cable 94 within the cylinder assembly 60. The piston cable 82 is attached to the lift cable equalizer pulley 86 which controls the lift cable 42. Finally, the takeup cable 94 is constantly tensioned by the takeup spring 100 between the free takeup pulley block 98 and the fixed takeup pulley block 102. Because the takeup cable 94 is attached to the piston cable 82 which controls the lift cable 42, the lift cable 42 is also constantly tensioned. Thus, as the force imparted by the lower window 26 on the lift cable 42 decreases during manual lifting, the force on the takeup cable 94 is similarly lessened. The takeup spring 100 maintains a tension in the takeup cable 94 by pulling the free takeup pulley block 98 away from the fixed takeup pulley block 102. Thus, the takeup cable 94 and the attached piston cable 82 and the lift cable 42 are drawn rightward within the cylinder assembly 60. Therefore, slack in the lift cable 42 is transmitted to lift cable equalizer pulley 86 which in turn is retracted toward the left by reaction of the takeup spring 100.

Cylinder Assembly 60

Figure 4A:
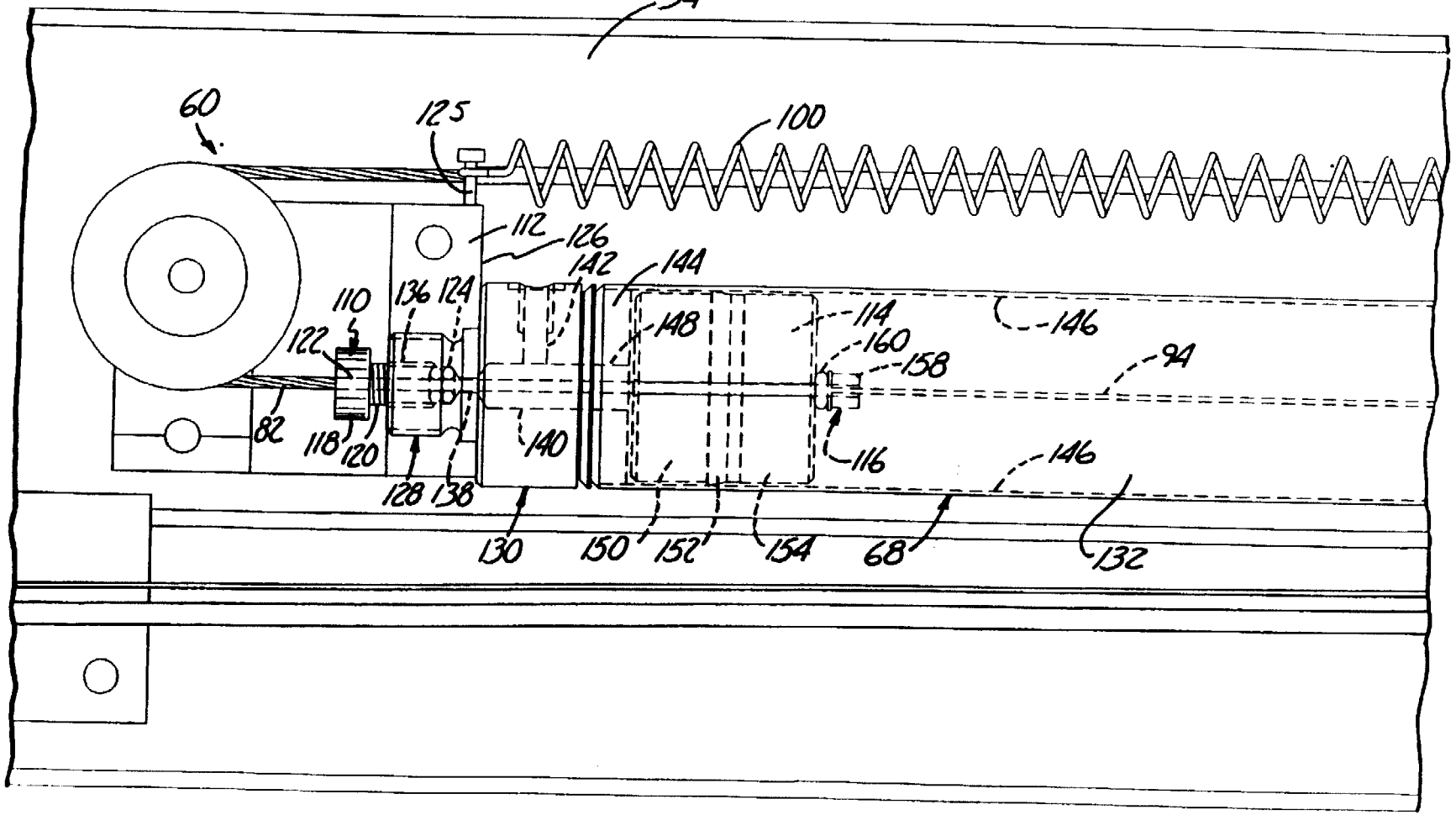
FIGS. 4A–4C are enlarged, front views of the cylinder assembly of the window propelling system.
Figure 4B:
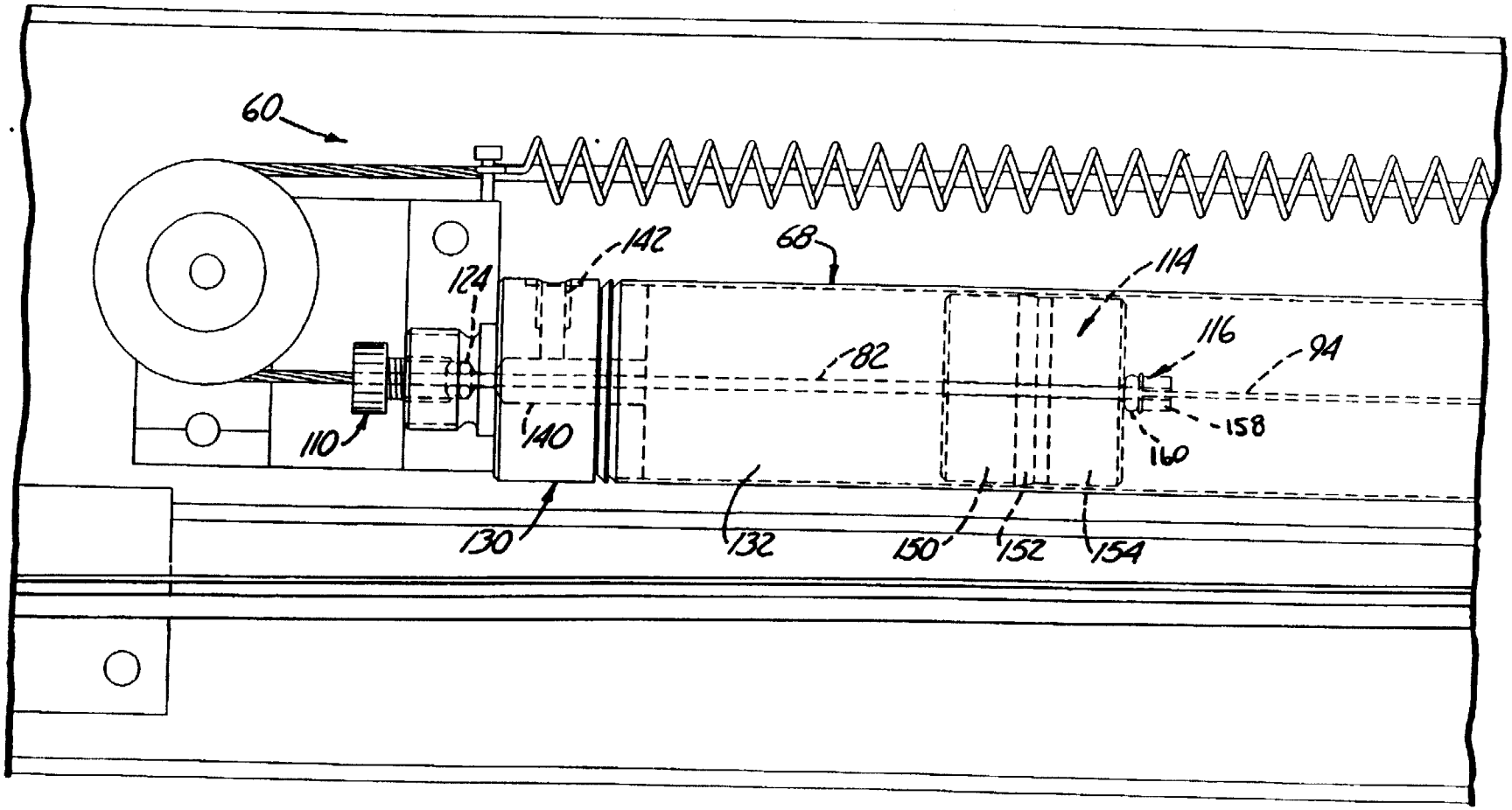
Figure 4C:
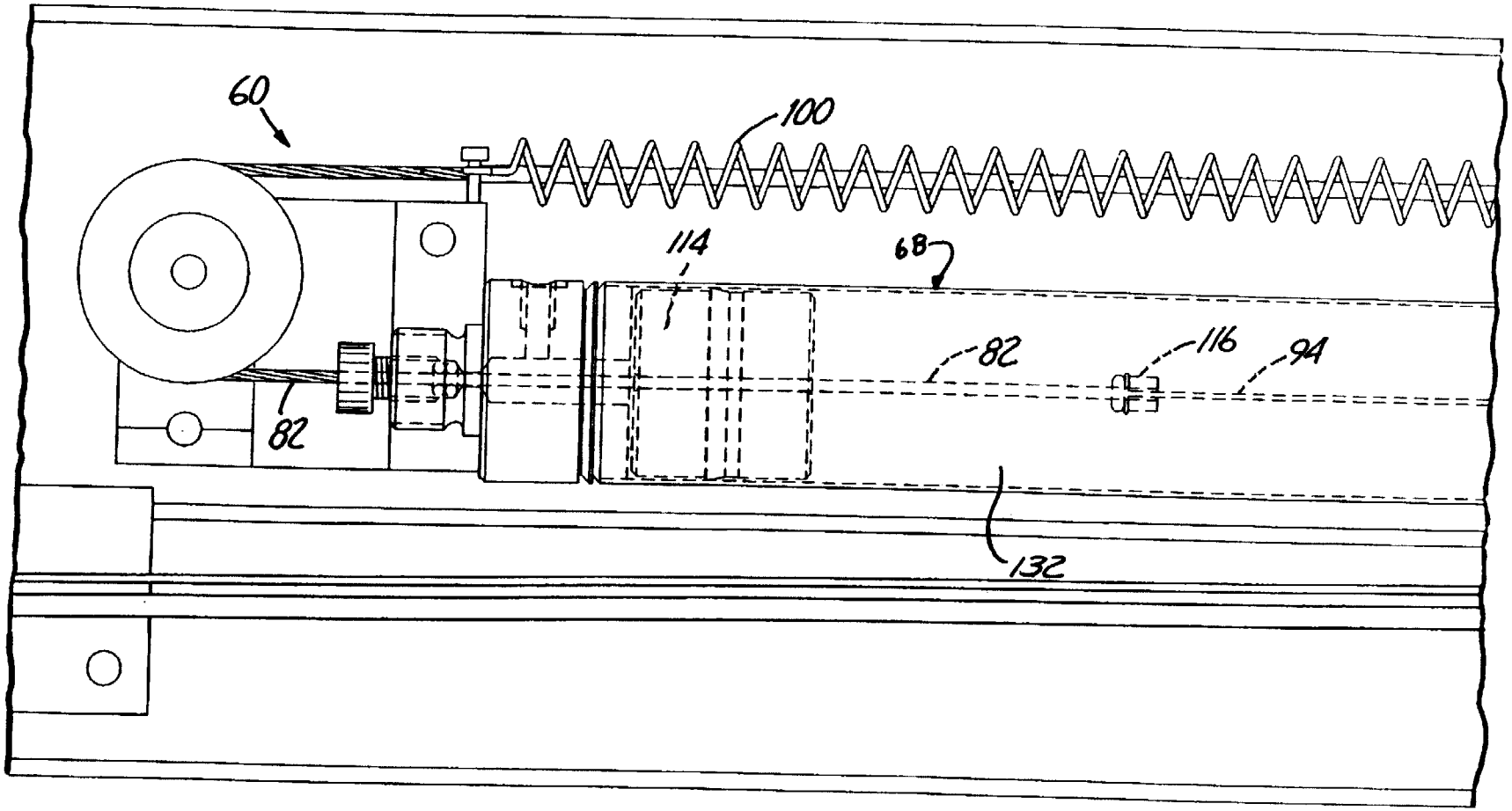

FIGS. 4A–4C provide greater details on the cylinder assembly 60 and operation thereof. The cylinder assembly 60 includes the piston cable 82, a cable seal screw 110, a frame 112, the cylinder 68, a piston 114, a piston cable seal 116 and a portion of the takeup cable 94.

The cable seal screw 110 includes a head 118, an exterior threaded surface 120, a central bore 122, and a leading end 124. The central bore 122 is sized to receive the piston cable 82. The leading end 124 is crimped. Thus, the leading end 124 allows the piston cable 82 to move back and forth, but is sealed about the piston cable 82 such that air or other fluids cannot pass through the central bore 122. The cable seal screw 110 is preferably made from stainless steel.

The frame 112 is attached to the housing 34, and includes a pin 125 and an attachment wall 126. The pin 125 is sized to maintain the takeup spring 100. The attachment wall 126 maintains a portion of the cylinder 68.

The cylinder 68 includes a flange 128, a shoulder 130 and a cylinder body 132. The flange 128 is a generally cylindrically shaped body, having an interiorly threaded opening 136 and a central passage 138. The interiorly threaded opening 136 is sized to threadably receive the exterior threaded surface 120 of the cable seal screw 110. The central passage 138 is sized to receive and allow movement of the piston cable 82. Preferably, the flange 128 is stainless steel.

The shoulder 130 includes a central bore 140 and a transverse port 142. The transverse port 142 is sized to receive the transmission line or tube 70 (FIG. 1B) and communicates with the central bore 140. The central bore 140 is larger in diameter than the piston cable 82. The shoulder 130 is fixed to the flange 128 such that the central passage 138 and the central bore 140 are aligned. Further, the flange 128 and the shoulder 130 are attached to the attachment wall 126 of the frame 112. In the preferred embodiment, the shoulder 130 is made from stainless steel.

The cylinder body 132 is preferably hollow, including an internal shoulder 144 and an inner wall 146. The internal shoulder 144 includes a central passage 148 having a diameter which matches that of the central bore 140 of the shoulder 130. The internal shoulder 144 is sized to receive the piston 114. The inner wall 146 has a diameter sized to maintain a portion of the piston 114. The cylinder body 132 is attached to the shoulder 130 such that the central bore 140 and the central passage 148 are aligned, and is preferably stainless steel.

The piston 114 includes a base 150, a neck 152 and a head 154, which are preferably formed as a single body. The base 150 is sized to abut the internal shoulder 144 of the cylinder body 132. The neck 152 has an outer diameter equal to an inner diameter of the inner wall 146 of the cylinder body 132. Thus, the neck 152 forms a seal with the inner wall 146 of the cylinder body 132. Finally, the piston 114 includes a central passage 156 sized to allow the piston cable 82 to move back and forth. Upon final assembly, the central passage 156 aligns with the central passage 148 of the cylinder body 132. In the preferred embodiment, the piston 114 is made of a rubber material.

The piston cable seal 116 includes a crimp 158 and a backup washer 160. The crimp 158 connects the piston cable 82 to the takeup cable 94. The backup washer 160 is attached to a face of the crimp 158 and to the piston cable 182. Further the backup washer 160 is positioned and sized to seat against the head 154 of the piston 114 such that the backup washer 160 seals the central passage 156 of the piston 114. Preferably, the crimp 158 is made from stainless steel, while the backup washer 158 is rubber.

Basically, the cylinder 68 is maintained about the piston cable 82 and the takeup cable 94. The cable seal screw 110 is threaded into the flange 128. The flange 128 is attached to the shoulder 130, for example by welding, such that the central passage 138 of the flange 128 mates with the central bore 140 of the shoulder 130. Similarly, the cylinder body 132 is attached to the shoulder 130, such as by welding. With the configuration shown in FIGS. 4A–4C, the central passage 148 of the cylinder body 132 mates with the central bore 140 of the shoulder 130. The piston 114 is disposed within the inner wall 146 of the cylinder body 132 such that the central passage 156 of the piston 114 aligns with the central bore 140 of the shoulder 130. The various components of the cylinder 68 are specifically designed to allow the piston cable 82 to move back and forth. However, the leading end 124 of the cable seal screw 110 is slightly crimped to seal fluid within the cylinder 68. In other words, fluid entering into the shoulder 130, via the transverse port 142, will not pass through the leading end 134 of the cable seal screw 110. Similarly, the piston cable seal 116 prevents fluid from escaping past the head 154 of the piston 114. However, because the piston cable 82 is allowed to freely move with respect to the piston 114, manual opening of the lower window 26 (FIG. 1A) can occur.

With respect to FIG. 4A, the piston cable 82 and the takeup cable 94 are shown with the lower window 26 (FIG. 1A) in a down position. The piston 114 is seated against the internal shoulder 144 of the cylinder body 132.

FIG. 4B represents the configuration of the cylinder assembly 60 during forced opening of the lower window 26 (FIG. 1A), just after firing. Forced fluid enters the cylinder 68 at the transverse port 142. The forced fluid proceeds from the transverse port 142 into the central bore 140 of the shoulder 130. The leading end 124 of the cable seal screw 110 prevents the forced fluid from escaping from the cylinder 68. Instead, the forced fluid acts upon the base 150 of the piston 114. More particularly, the forced fluid enters the cylinder body 132 and forces the piston 80 to the right (with respect to the orientation shown in FIGS. 4A–4C). The piston cable seal 116 seals against the head 154 of the piston 114. Further, the neck 152 seals the piston 114 within the cylinder body 132 such that the forced fluid will not escape around or through the piston 114. Forced movement of the piston 80 is imparted onto the piston cable seal 126, and in turn to the piston cable 82 and the takeup cable 94. Thus, the forced fluid forces the piston cable 82 and the takeup cable 94 to move in a rightward direction with respect to the cylinder 68. Once again, forced movement of the piston cable 82 is directed to the lift cable equalizer pulley 86 (FIG. 2) which moves the lift cable 42 (FIG. 2) to open the lower window 26 (FIG. 2).

FIG. 4C depicts orientation of the piston cable 82 and the takeup cable 94 during a manual opening of the lower window 26 (FIG. 1A). As previously described, manual opening of the lower window 26 (FIG. 1A) draws the takeup cable 94 rightward within the cylinder body 132 via tension from the takeup spring 100 on the free takeup pulley block 98 (FIG. 3). The takeup cable 94 is attached to the piston cable 82 at the piston cable seal 116. Thus, rightward movement force on the takeup cable 94 is imparted onto the piston cable 82, drawing the piston cable 82 rightward within the cylinder body 132. Notably, the cylinder assembly 60 components are configured to allow this movement. Movement of the piston cable 82 is imparted onto the lift cable 42 (FIG. 2) via the lift cable equalizer pulley 86 (FIG. 2), thereby eliminating slack in the lift cable 42 during manual opening. The piston 114 remains fixed with respect to the cylinder body 132.

Notably, the self-propelling action will occur regardless if the lower window 26 (FIG. 1A) is closed or partially open. If the lower window 26 (FIG. 1A) is partially open, the piston 80 is driven forward until it contacts the piston cable seal 116. From this position, further movement of the piston 80 acts on the piston cable seal 116 and thus the lift cable 42, forcing the lower window 26 open.

Hammer Assembly 62 And Firing Assembly 64

Figure 5A:
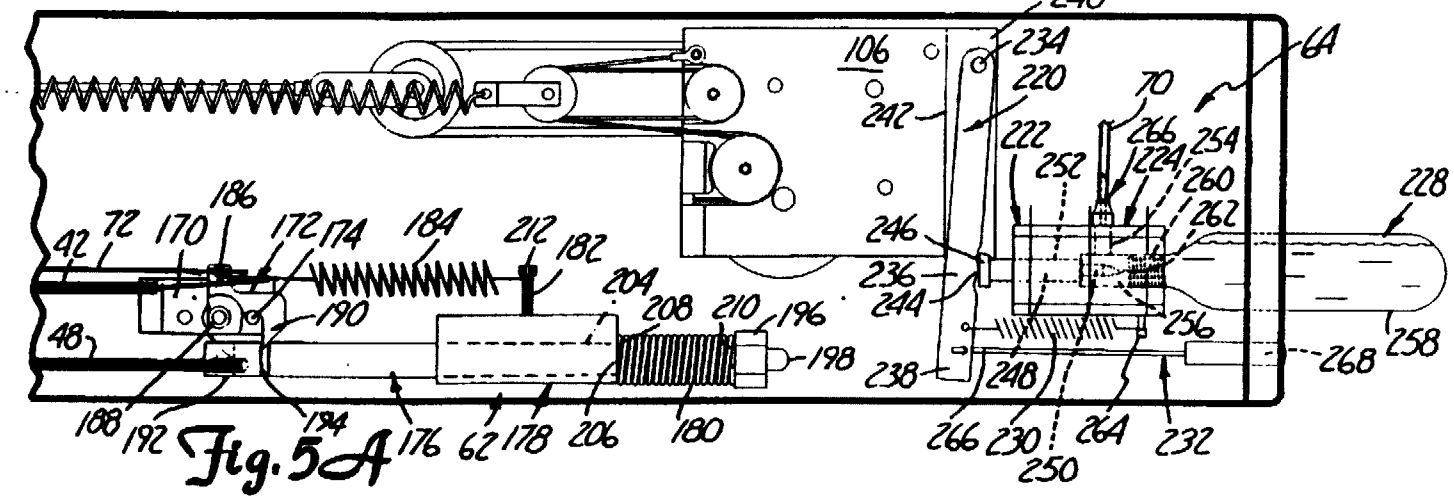
FIGS. 5A and 5B are enlarged, front views of the firing assembly and the hammer assembly of the window propelling system.
Figure 5B:
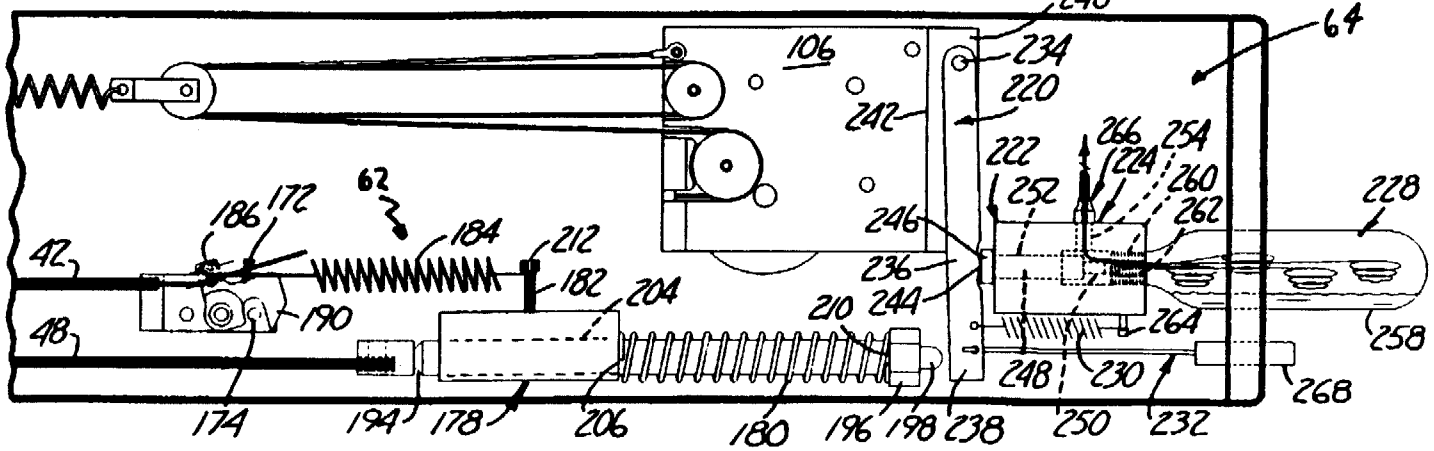

FIGS. 5A and 5B represent the hammer assembly 62 and the firing assembly 64. More specifically, FIG. 5A represents the hammer assembly 62 and the firing assembly 64 in an unfired position. FIG. 5B depicts the hammer assembly 62 and the firing assembly 64 subsequent to firing of the device. For purposes of clarity, FIGS. 5A and 5B show only a portion of the lift assembly 58 and the cylinder assembly 60 has been removed.

The hammer assembly 62 includes a base 170, a pawl 172, a stop pin 174, a hammer shaft 176, a hammer bearing block 178, a hammer spring 180, a pin 182 and a pawl spring 184.

The base 170 is attached to and extends upwardly from the housing 34. In the preferred embodiment, the base 170 is made from stainless steel.

The pawl 172 includes a cable connecting end 186, a pivot point 188 and a tang 190. The pawl 172 is preferably formed as a singular body. The cable connecting end 186 is connected to the interior triggering cable 46, the secondary triggering cable 72 and the pawl spring 184. The pivot point 188 is configured for pivoting attachment to the base 170. Finally, the tang 190 extends from the pivot point 188. More particularly, the tang 190 is configured to receive the stop pin 174. Further, the tang 190 includes a point for engaging a portion of the hammer shaft 176. The pawl 172 is preferably made from stainless steel.

The hammer shaft 176 is preferably a cylindrical-shaped body and includes a clamping end 192, a groove 194, a spring retaining extension 196 and a tip 198. The clamping end 192 is configured to receive and maintain the cocking lanyard 48. The groove 194 is sized to receive the tang 190 of the pawl 172. The spring retaining extension 196 is configured to maintain one end of the hammer spring 180. Finally, the tip 198 is preferably concave in shape, for contacting a portion of the firing assembly 64.

The hammer bearing block 178 is attached to the housing 34 and includes a central bore 204 and a spring retaining face 206. The central bore 204 has a diameter which is slightly larger than that of the hammer shaft 176. Thus, the hammer shaft 176 is allowed to move back and forth within the hammer bearing block 178. However, the central bore 204 is configured to guide movement of the hammer shaft 176. The hammer bearing block 178 is preferably make from stainless steel.

The hammer spring 180 has an inner diameter which is slightly larger than a diameter of the hammer shaft 176 and the central bore 204 in the hammer bearing block 178. A first end 208 of the hammer spring 180 is sized to abut the spring retaining face 206 of the hammer bearing block 178. A second end 210 of the hammer spring 180 is configured to abut the spring retaining extension 196 of the hammer shaft 176. Thus, the hammer spring 180 is fixed at the first end 208 to the hammer bearing block 178; and at the second end 210 to the spring retaining extension 196 of the hammer shaft 176.

The pin 182 extends outwardly from the hammer bearing block 178. The pin 182 includes a retaining end 212 which is configured to maintain a portion of the pawl spring 184. The pin 182 is preferably made of stainless steel.

The pawl spring 184 is configured for attachment to the cable connecting end 188 of the pawl 172 and the pin 184.

The hammer assembly 62 is constructed basically as follows. The hammer spring 180 is positioned about the hammer shaft 176 such that the second end 210 of the hammer spring 180 abuts the spring retaining extension 196. The hammer shaft 180 is placed through the central bore 204 in the hammer bearing block 178. The cocking lanyard 48 is secured to the clamping end 192 of the hammer shaft 176. The cocking lanyard 48 is pulled to draw the hammer shaft 176 in a rearward fashion, compressing the hammer spring 180 between the hammer bearing block 178 and the spring retaining extension 196 of the hammer shaft 176. The hammer shaft 176 is positioned such that the groove 194 mates with the tang 190 of the pawl 172. The stop pin 174 ensures proper placement of the pawl 172 with respect to the hammer shaft 176.

The pawl spring 184 is tensioned between the pawl 172 and the pin 182. Thus, the pawl spring 184 tensions the pawl 172 about the pivot point 188 such that the tang 190 maintains engagement with the groove 194 of the hammer shaft 176 as shown in FIG. 5A. The interior triggering cable 46 and the secondary triggering cable 72 are attached to the cable connecting end 186 of the pawl 172. Prior to firing, the hammer assembly 62 is statically maintained in the position shown in FIG. 5A, with the pawl spring 184 in tension, and the hammer spring 180 compressed.

A slight rearward pulling force imparted on the cable connecting end 186 of the pawl 172, by either the interior triggering cable 46 or the secondary triggering cable 72, causes the pawl 172 to rotate about the pivot point 188 in a counter clockwise fashion. This action, in turn, disengages the tang 190 from the groove 194. The hammer spring 180 releases its stored energy, forcing the tip 198 of the hammer shaft 176 forward, striking a portion of the firing assembly 64. The hammer bearing block 178 guides the hammer shaft 176 during the firing motion.

The hammer assembly 62 is reset by pulling on the cocking lanyard 48. This action brings the hammer shaft 176 into contact with the pawl 172, such that the tang 190 nests within the groove 194. The hammer spring 180 is returned to a compressed state. The pawl spring 184 ensures that the pawl 172 maintains the hammer shaft 176 in the ready position, shown in FIG. 5A.

As previously described, the hammer assembly 62 activates the firing assembly 64. The firing assembly 64 includes a puncture lever 220, a puncture needle 222, a fluid source block 224, a nozzle fitting 226, a pressurized fluid source 228, a retaining spring 230 and a puncture indicator 232.

The puncture lever 220 includes a pivot end 234, a needle engaging portion 236 and a leading end 238. The pivot end 234 is pivotally attached to a portion of the frame 106. In this regard, the frame 106 includes a ledge 240 and a side wall 242. The ledge 240 is recessed from a remainder of the frame 106, thus forming the side wall 242. The pivot end 234 is connected to the ledge 240 such that the side wall 242 inhibits movement of the puncture lever 220. The needle engaging portion 236 is configured to communicate with the puncture needle 222. More particularly, the needle engaging portion 236 includes two grooves which form a point 244. The point 244 is configured to contact the puncture needle 222. In the preferred embodiment, the puncture lever 220 is made from stainless steel.

The puncture needle 222 includes a head 246, a body 248 and a puncture point 250. In the preferred embodiment, the puncture needle 222 is made from stainless steel.

The fluid source block 224 is attached to the housing 34. The fluid source block 224 is preferably a rectangular shaped body and includes a central passage 252, a transverse passage 254 and a threaded bore 256. The central passage 252 is sized to slidably receive the puncture needle 222. Further, the central passage 252 communicates with the threaded bore 256. However, the relationship between the body 248 of the puncture needle 222 and the central passage 252 is such that a seal is formed, so that fluid will not pass into the central passage 252. The transverse passage 254 is configured to communicate with the threaded bore 256. Finally, the threaded bore 256 is interiorly threaded to receive a portion of the pressurized fluid source 228.

The nozzle fitting 226 extends from the fluid source block 224. In particular, the nozzle fitting 226 is connected at one end to the transverse passage 254 of the fluid source block 224 and at an other end to the transmission line 70. The nozzle fitting 226 is configured to receive fluid from the transverse passage 254 and direct it to the transmission line 70. Thus, the nozzle fitting 226 is sealed against the fluid source block 224. The nozzle fitting 226 is preferably stainless steel.

The pressurized fluid source 228 includes a container 258 and an exteriorly threaded neck 260. The container 258 contains a pressurized fluid, such as carbon dioxide. The exteriorly threaded neck 260 is sized to mate with the threaded bore 256 of the fluid source block 224. Further, the exteriorly threaded neck 260 terminates at a sealed end 262. The exteriorly threaded neck 260 and the sealed end 262 are designed to have a diameter larger than a diameter of the puncture point 250 of the puncture needle 222. In the preferred embodiment, the sealed end 262 is preferably a thin material, such as aluminum, which can be punctured by the puncture needle 222. As shown in FIGS. 5A and 5B, a portion of the container 258 extends outwardly from the housing 34, so that it is visible.

The retaining spring 230 is configured to be connected to the puncture lever 220 and a pin 264 extending from the fluid source block 224.

The puncture indicator 232 includes a shaft 266 and a head 268. The head 268 extends from the shaft 266. Further, the head 268 is sized to pass through a hole (not shown) in the housing 34. The head 268 is preferably brightly colored, for reasons described in greater detail below. The puncture indicator 232 is made from strong, rigid material, such as plastic.

As shown in FIG. 5A, the puncture lever 220 is pivotally attached to the ledge 240 of the frame 106. The puncture needle 222 is positioned in the central passage 252 of the fluid source block 224. The pressurized fluid source 228 is connected to the fluid source block 224 by threading the exteriorly threaded neck 260 into the threaded bore 256. The sealed end 262 contacts the puncture point 250 of the puncture needle 222.

The retaining spring 230 is slightly tensioned between the pin 264 and the puncture lever 220 to pull the puncture lever 220 towards the fluid source block 224. With this configuration, the point 244 of the puncture lever 220 contacts the head 246 of the puncture needle 222. Notably, the tension force generated by the retaining spring 230 is quite small. Therefore, with the orientation shown in FIG. 5A, the force placed on the puncture needle 222 by the puncture lever 220 is not enough to cause the puncture point 250 to break the sealed end 262 of the pressurized fluid source 228. Finally, the puncture indicator 232 is positioned such that the head 268 is approximately even with the side of the housing 34. Once again, the configuration shown in FIG. 5A is static prior to release of the hammer assembly 62.

FIG. 5B depicts the firing assembly 64 after the hammer assembly 62 has been released. In particular, the tip 198 of the hammer shaft 176 contacts the leading end 238 of the puncture lever 220, propelling the puncture lever 220 toward the puncture needle 222. The puncture lever 220, via the point 244, forces the puncture needle 222 towards the pressurized fluid source 228. In particular, the puncture point 250 is forced through the sealed end 262 of the pressurized fluid source 228. The diameter of the puncture point 250 is smaller than an inner diameter of the exteriorly threaded neck 260. Thus, pressurized fluid within the container 258 is propelled from the container 258, through the exteriorly threaded neck 260, around the puncture point 250 and into the threaded bore 256. The central passage 252 in the fluid source block 224 is sealed by the body248 of the puncture needle 222 such that the pressurized fluid is forced from the threaded bore 256 solely into the transverse passage 254. Notably, the side wall 242 prevents the puncture needle 222 from disengaging the central passage 252 of the fluid source block 224. The side wall 242 stops leftward movement of the lever arm 220, which in turn stops movement of the puncture needle 222. The pressurized fluid passes from the transverse passage 254, into the nozzle fitting 266 where it is directed into the transmission line 70. As previously described, the transmission line 70 is in communication with the cylinder assembly 60 (FIG. 2). Thus, forced fluid from the pressurized fluid source 228 enters the cylinder 68 (FIG. 2), resulting in opening of the lower window 26 (FIG. 1A).

In addition to initiating the lifting action, the firing assembly 64 also provides an indication to a user that the pressurized fluid source 228 has been emptied. As shown in FIG. 5B, as the puncture lever 220 forces the puncture needle 222 toward the pressurized fluid source 228, the head 268 of the puncture indicator 232 is forced beyond the housing 34. In the preferred embodiment, the head 268 is brightly colored. Therefore, when the head 268 extends beyond the housing 34, a user has visual indication that the puncture lever 222 has moved and thus that the pressurized fluid source 228 is emptied. Even further, a slight leak in the sealed end 262 of the pressurized fluid source 228 will also be indicated by the puncture indicator 232. Under normal conditions, when the sealed end 262 is complete, the retaining spring 230 is configured such that it does not maintain enough tension energy to force the puncture needle 222 through the sealed end 262. However, when the sealed end 262 has a flaw or small leak, the retaining spring 230 will move the puncture lever 220 slightly. Once again, this action of the puncture lever 220 forces at least a portion of the head 268 of the puncture indicator 232 beyond a side wall of the housing 34. Thus, the puncture indicator provides visual indication of a leaking pressurized fluid source 228.

Following a firing (FIG. 5B), the hammer assembly 62 and the firing assembly 64 are returned to their pre-firing position. Once again, the cocking lanyard 48 is pulled to reset the hammer assembly 62 to the position shown in FIG. 5A. The emptied pressurized fluid source 228 is unscrewed from the fluid source block 224 and replaced with a new pressurized fluid source 228. As the new pressurized fluid source 228 is threaded into the threaded bore 256 of the fluid source block 224, the sealed end 262 forces the puncture needle 222 towards the puncture lever 220. While the retaining spring 230, via the puncture lever 220, maintains the puncture needle 222 tightly against the sealed end 262 of the pressurized fluid source 228, it does not generate enough force to puncture the sealed end 262. Therefore, the new pressurized fluid source 228 is guided into the fluid source block 224 to the position shown in FIG. 5A. In the final position of the puncture lever 220, the puncture indicator 232 is maintained such that the head 268 is within the housing 34.

Secondary Trigger Assembly 66

Figure 6A:
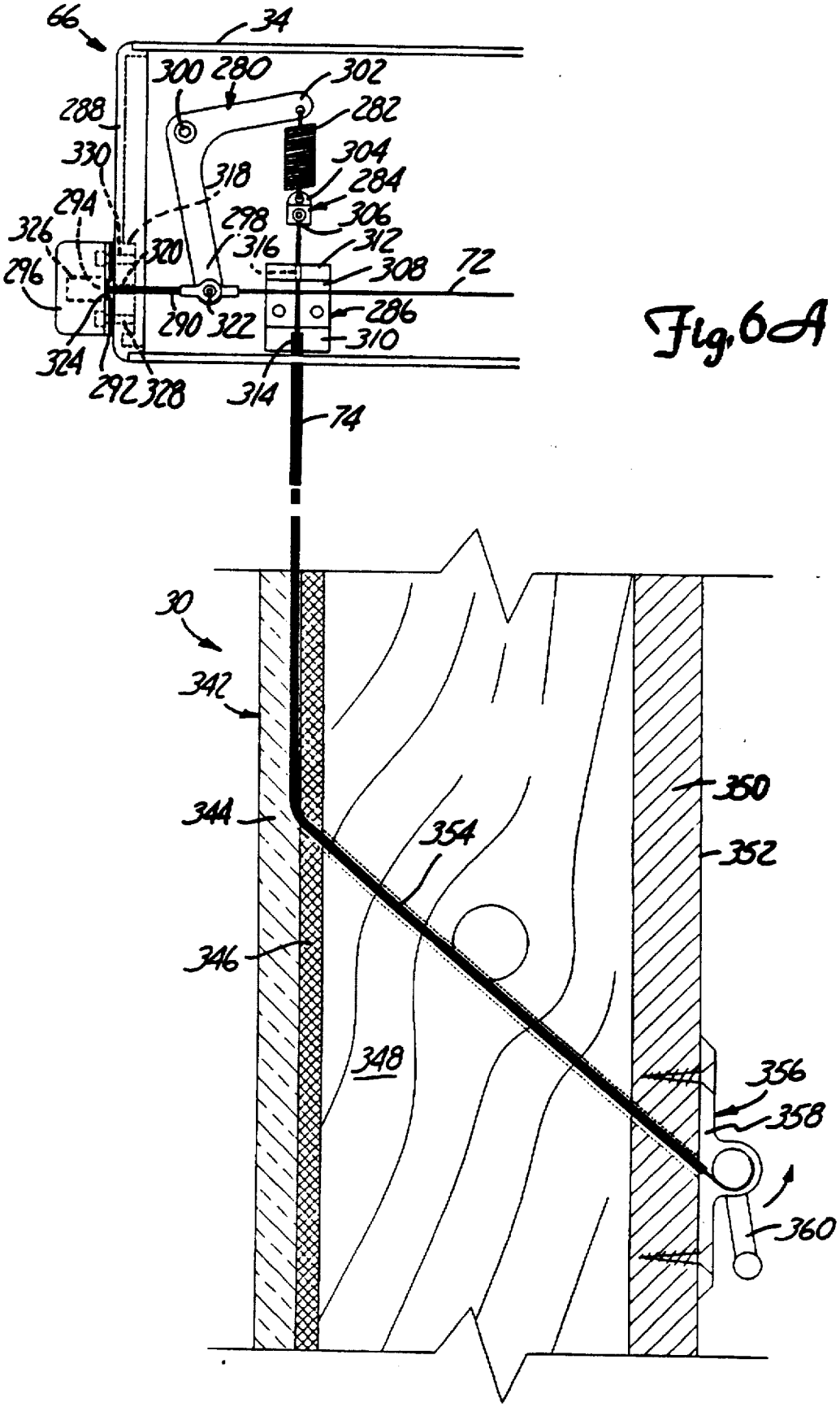
FIGS. 6A and 6B are enlarged, front views of the secondary trigger assembly of the window propelling system.
Figure 6B:
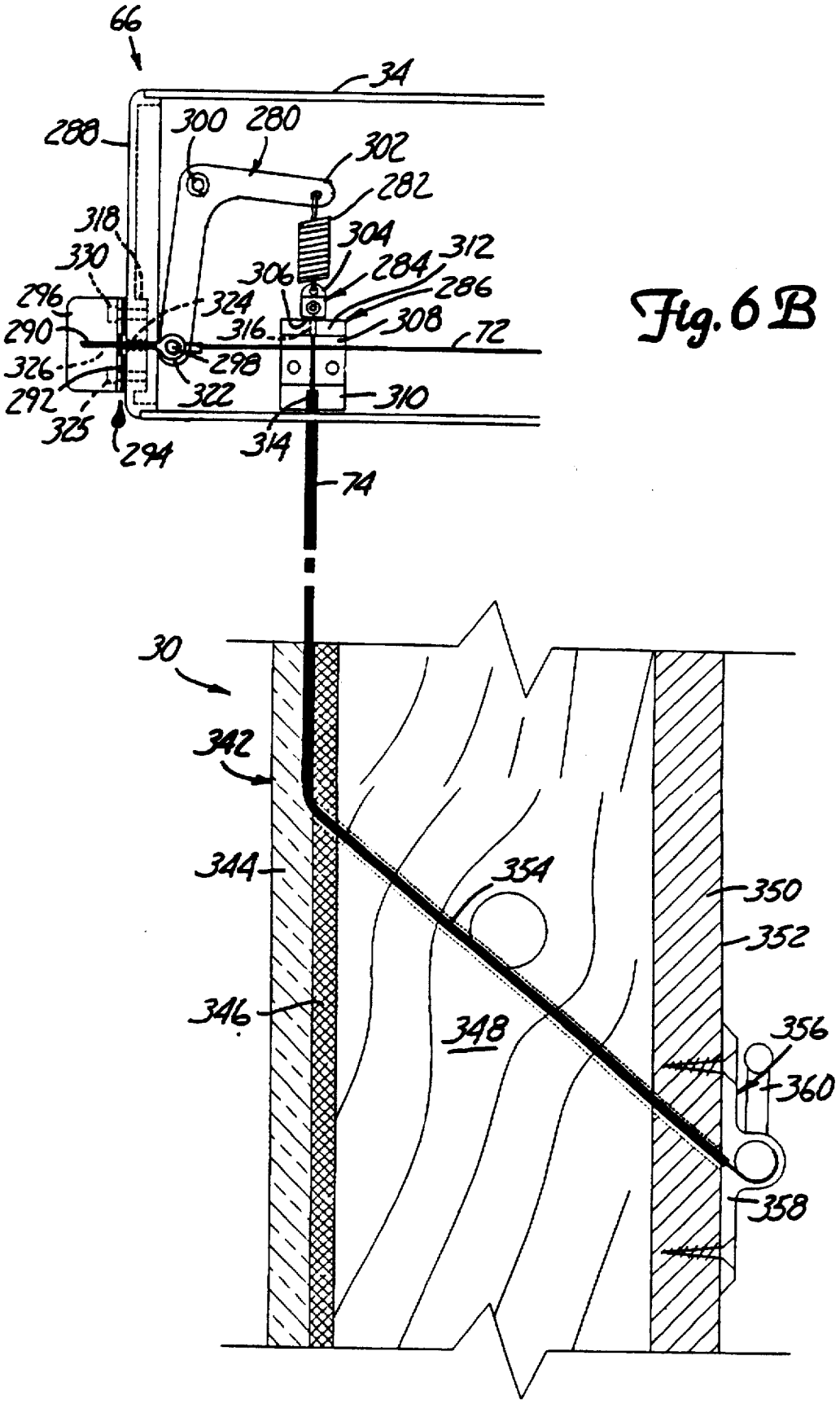

FIGS. 6A and 6B provide further details on the secondary trigger assembly 66. To better illustrate the secondary trigger assembly 66, only a relevant portion of the housing 34 is shown along with the wall 30. The secondary trigger assembly 66 includes a bell crank 280, a spring 282, a connector 284, a cable block 286, an end cap 288, a push pin 290, a thermal insulator 292, a meltable disk 294 and a heat sink 296.

The bell crank 280 includes a cable connection end 298, a pivot point 300 and a spring connection end 302. The bell crank 280 is preferably L-shaped, and is connected to the housing 34 at the pivot point 300. The bell crank 80 is configured to pivot with respect to the housing 34 at the pivot point 300. In the preferred embodiment, the bell crank 280 is made from stainless steel.

The connector 284 is preferably a square-shaped body, having a spring extension 304 and a stop face 306. The spring extension 304 is configured to maintain an end of the spring 282. Further, the connector 284 is configured to maintain an end of the exterior initiating cable 74 at a point near the stop face 306. Notably, the exterior initiating cable 74 is shown in FIGS. 6A and 6B as including a sheath which covers a cable. The cable portion of the exterior initiating cable 74 is attached to the connector 284, while the sheath is removed inside of the housing 34. Finally, the stop face 306 is preferably flat, configured to interface with a portion of the cable block 286.

The cable block 286 includes a base 308, a first leg 310 and a second leg 312. The base 308 is attached to the housing 34. The first leg 310 and the second leg 312 extend from the base 308. The first leg 310 includes a guide 314 sized to receive the exterior initiating cable 74. Similarly, the second leg 312 includes a passage 316 sized to receive the exterior initiating cable 74. The second leg 312 is also configured to receive the stop face 306 of the connector 284. In other words, the second leg 312 will impede or stop movement of the connector 284 upon contact. Finally, the area between the first leg 310 and the second leg 312 is recessed such that the exterior initiating cable 74 and the secondary triggering cable 72 are not impeded by the cable block 286. The cable block 286 is preferably made of stainless steel.

The end cap 288 is configured to mate with ends of the housing 34. The end cap 288 includes a recessed area 318 for receiving a portion of the heat sink 296. Finally, the end cap 288 includes a central passage 320 for receiving the push pin 290. The end cap 288 is made of rigid material, such as plastic, which is heat resistant.

The push pin 290 is a rigid body, having a clasp 322 and a leading end 324. The clasp 322 is configured to pivotally attach the push pin 290 to the cable connection end 298 of the bell crank 280. The push pin 290 is preferably made from a rigid material, such as stainless steel, having a high melting point. Finally, the push pin 290 has a diameter sized to pass through the passage 320 in the end cap 288.

The thermal insulator 292 is preferably a flat ring, having a central opening sized for passage of the push pin 290. The thermal insulator 292 is preferably made from a standard insulating material such as fiberglass.

The meltable disk 294 is a small, continuous body having an outer diameter larger than the diameter of the push pin 290. In the preferred embodiment, the meltable disk 294 is threaded and is made from solder having a low melting point, in the range of 120 degrees fahrenheit.

The heat sink 296 is preferably a V-shaped body having fins 325 and a central opening 326. The fins 325 are configured to conduct heat toward the central opening 326. The central opening 326 is preferably threaded to receive and maintain the meltable disk 294 and has a diameter large enough to allow passage of the push pin 290. The heat sink 296 is preferably made from material having high thermal conductivity characteristics, such as aluminum.

The secondary trigger assembly 266 is constructed substantially as follows. The bell crank 280 is pivotally attached to the housing 34 at the pivot point 300. The spring 282 is attached at one end of the spring connection end 302 of the bell crank 280; at an other end to the spring extension 304 of the connector 284. The connector 284, in turn, is attached to the exterior initiating cable 74 opposite the spring 282. The cable block 286 is attached at the base 308 to the housing 34 such that the exterior initiating cable 74 extends through the passage 316 in the second leg 312 and the guide 314 in the first leg 310. As described in greater detail below, the exterior initiating cable 74 extends from the housing 34 and is connected to an exterior switch. The secondary triggering cable 72 and the push pin 290 are attached to the cable connection end 298 of the bell crank 280 as shown in FIGS. 6A and 6B. As previously described, the secondary triggering cable 72 extends from the bell crank 280 and is attached to the hammer assembly 62 (FIG. 5A).

The end cap 288 is disposed over the housing 34 as shown in FIGS. 6A and 6B. The bell crank 280 is such that the push pin 290 extends only partially through the passage 320 in the end cap 288. The thermal insulator 292 is placed adjacent the end cap 288 such that its central opening aligns with the push pin 290. The meltable disk 294 is threaded into the central opening 326 of the thermal insulator 292. Finally, the heat sink 296 is attached to the end cap 288 via screws 328 and 330. When properly orientated, the leading end 324 of the push pin 290 abuts the meltable disk 294. The heat sink 296 and the thermal insulator 292 are held in place by the screws 328, 330. The thermal insulator 292 forms a gap between the heat sink 296 and the end cap 288. With the configuration shown in FIG. 6A, the spring 282 is in a relaxed state, and the secondary trigger assembly 66 is static. The secondary trigger assembly is initiated by movement of the exterior initiating cable 74.

As previously described, the exterior initiating cable 74 extends from the secondary trigger assembly 66 through the wall 30. The wall 30 is defined by an interior side 342, an interior window trim 344, sheet rock 346, a stud 348, an exterior window trim 350 and an exterior side 352. As shown in FIGS. 6A and 6B, the exterior initiating cable 74 extends downwardly from the secondary trigger assembly 60 along a gap formed between the interior window trim 344 and the sheet rock 346. The exterior initiating cable 74 is directed through an angled bore 354 in the sheet rock 346, the stud 348 and the exterior window trim 350. The exterior initiating cable 74 terminates at an outside switch 356 which is attached to the exterior window trim 350 as shown in FIGS. 6A and 6B. The outside switch 356 includes a base 358 and a lever arm 360. The lever arm 360 is rotatably attached to the base 358. Further, the lever arm 360 is also attached to the exterior initiating cable 74.

The secondary trigger assembly 66 is activated by maneuvering the outside switch 356 from a closed position (FIG. 6A) to an open position (FIG. 6B). More particularly, the lever arm 360 is rotated upward with respect to the base 358. This motion is transferred through the length of the exterior initiating cable 74, pulling the connector 284 downward. Notably, the distance between the stop face 306 of the connector 284 and the second leg 312 of the cable block 286 is approximately equal to the rotational movement of the outside switch 356. However, the cable block 286 acts as a stop to the connector 284 such that further movement of the connector 284 is prevented.

As the connector 284 moves closer to the cable block 286, a tension force is created in the spring 282. As a result, the spring 282 creates a force on the spring connection end 302 of the bell crank 280. This force is transposed to the pivot point 300 of the bell crank 280 and attempts to generate a clockwise movement of the bell crank 280. However, the meltable disk 294 interacts with the push pin 290 to prevent this movement. In other words, under normal conditions, the cable connection end 298 of the bell crank 280, via interaction of the push pin 290 with the meltable disk 294, offsets the rotational force generated by the spring 282. Thus, movement of the switch 356 does not automatically cause firing of the secondary trigger assembly 66. Instead, the spring 282 remains in a static position, imparting a continuous, but offset force on the bell crank 280.

The bell crank 280 will only rotate if the meltable disk 294 is removed. This occurs when the heat sink 296 reaches a temperature greater than a melting point of the meltable disk 294. For example, during a fire, the heat sink 296 will reach a temperature level which causes the meltable disk 294 to melt, as shown in FIG. 6B. Once the meltable disk 294 melts, the force generated by the spring 282 on the bell crank 280 forces the push pin 290 through the central opening 326 in the heat sink 296. This action, in turn, moves the cable connection end 298 of the bell crank 280, and thus the secondary triggering cable 72 in a leftward direction. As previously described, movement of the secondary triggering cable 72 results in release of the hammer assembly 62 (FIGS. 5A and 5B). Once the hammer assembly 62 (FIGS. 5A and 5B) is released, the lift assembly 58 (FIG. 1B) raises the lower window 26 (FIG. 1A).

The secondary trigger assembly 66 provides a unique device for rescue workers, such as fire persons, to open the lower window 26 (FIG. 1A) in an emergency situation. The rescue worker simply maneuvers the switch 356 to the open position (shown in FIG. 6B). If a fire is near the window assembly 22 (FIG. 1A), the secondary trigger assembly 66 will open the lower window 26 (FIG. 1A). However, the switch 356 cannot be used by a burglar or unwanted individual for easy access into the home. The cable block 286 is specifically designed to stop movement of the connector 284. Thus, tension on the spring 282, and therefore force on the bell crank 280 will never exceed a predetermined level. Further, the meltable disk 294 is threaded into engagement with the heat sink 296 to prevent the meltable disk 294 from being pushed out by the push pin 290 as a solid disk.

Trigger 40

Figure 7A:
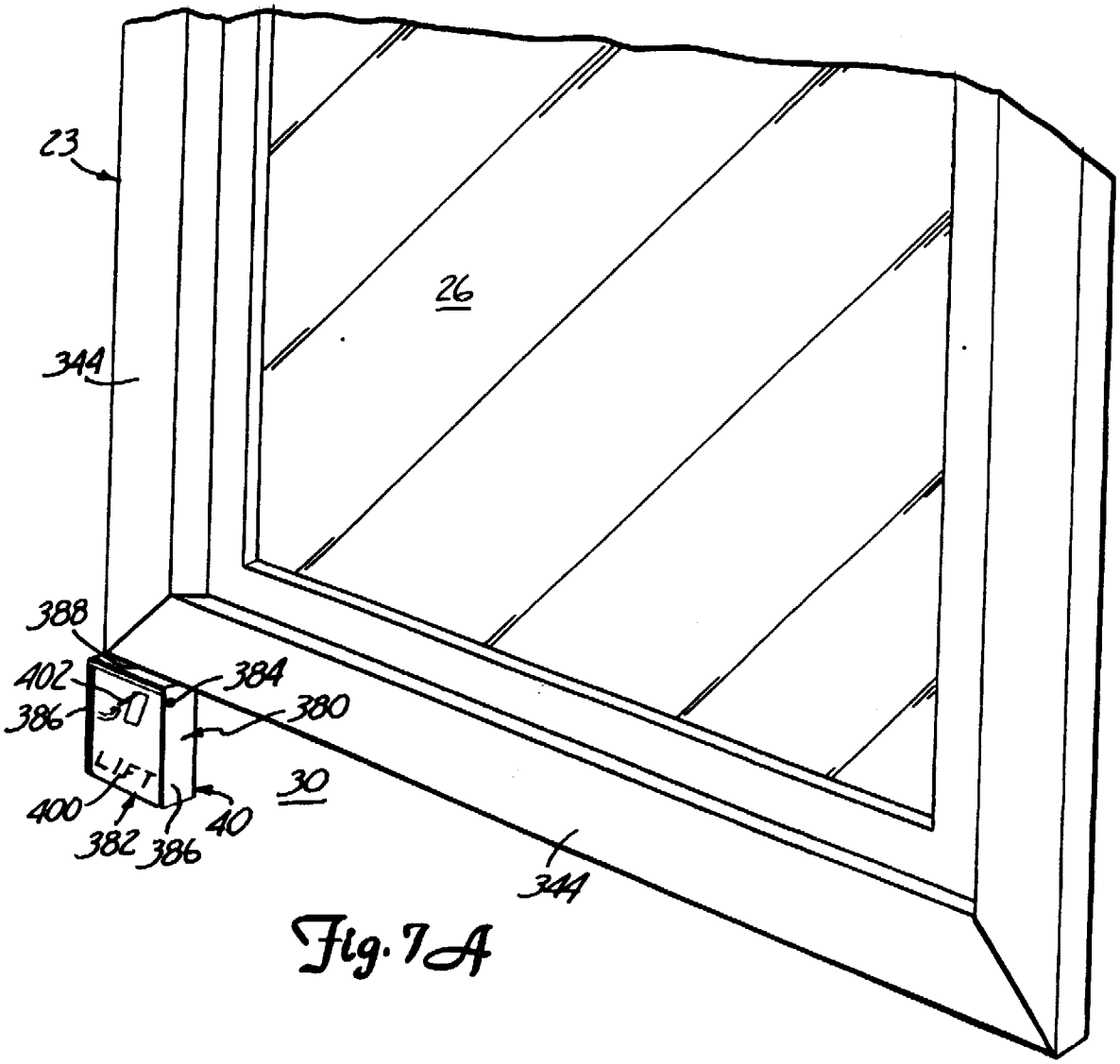
FIG. 7A is a perspective view of the trigger of the window propelling system.
Figure 7C:
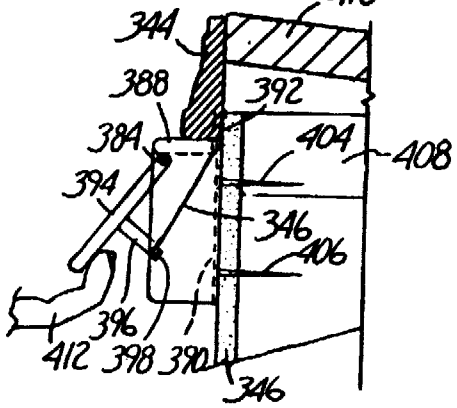
FIGS. 7B–7C are side sectional views of the trigger of FIG. 7A.
Figure 7B:
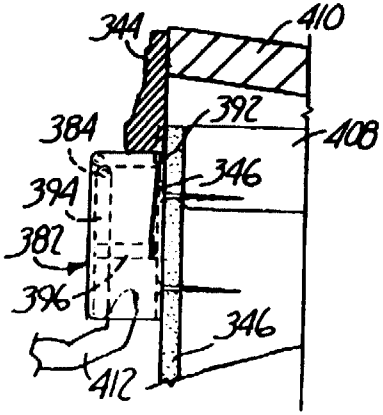

FIGS. 7A–7C provide further details on the trigger 40. In particular, FIG. 7A is a perspective view of the trigger 40 as it relates to the window assembly 22. FIG. 7B is a side sectional view of the trigger 40 in an unfired position. Finally, FIG. 7C is a side sectional view of the trigger 40 in the fired position.

As shown in FIGS. 7A–7C, the trigger 40 includes a case 380, a lever arm 382 and a pin 384. The case 380 includes side walls 386, a top wall 388 and a rear wall 390. A gap 392 is formed between the top wall 388 and the rear wall 390, sized for passage of the interior triggering cable 46. In the preferred embodiment, the case 380 is made from sheet metal. However, other rigid materials, such as reinforced plastic, are also acceptable.

The lever arm 382 includes a finger plate 394 and a cross bar 396. The cross bar 396 extends from a center of the finger plate 394 and includes a fastening end 398 for attachment to the interior triggering cable 46. Finally, the lever arm 382 includes indicia 400 and 402 on a front face of the finger plate 394. The indicia 400 and 402 preferably provide visual instructions, via words and/or drawings, of how the trigger 40 operates.

The pin 384 extends between the side walls 386 of the case 380 and maintains the lever arm 382. More particularly, the pin 384 pivotally attaches the finger plate 394 to the side walls 386.

The case 380 is attached to the wall 30 by wood screws 404 and 406. As shown in FIG. 7A the case 380 is positioned on the wall 30 such that the top wall 388 abuts the interior window trim 344. Further, the case 380 is positioned approximately parallel with an edge of the interior window trim 344 to facilitate extension of the interior triggering cable 46 upwardly from the case 380. The case 380 is preferably positioned away from a center of the window assembly 22 to prevent accidental activation of the trigger 40 by an emergency worker entering the window assembly 22 from outside the room.

The wood screws 404, 406 maintain the trigger 40 in the above-described position. More particularly, the wood screws 404, 406 attach the rear wall 390 of the case 380 to the sheet rock 346 of the wall 30. In the preferred embodiment, at least one of the wood screws 404 or 406 attaches into a stud 408. As with most window assemblies, the stud 408 is located slightly below a window sill 410 otherwise attached to the interior window trim 344. Finally, the interior triggering cable 46 extends from the lever arm 382 through the gap 392 in the case 380. The interior triggering 46 terminates at the hammer assembly 62 (FIG. 1B). Extension of the interior triggering cable 46 is preferably positioned between the interior window trim 344 and the sheet rock 346. In this regard, the window trim 344 is simply removed during installation, and then replaced over the interior triggering cable 46. However, the interior triggering cable 46 can alternatively be attached along the wall 30 in close proximity to the interior window trim 344.

As shown in FIG. 7B, in the unfired state, the finger plate 394 is approximately perpendicular to the top wall 388 of the case 380. In the unfired state, the interior triggering cable 46 is untensioned. To initiate the trigger 40, a user's finger 412 is placed behind the finger plate 394 of the lever arm 382. The user's finger 412 simply lifts the lever arm 382 upwards, thus pulling the interior triggering cable 46. The lever arm 382 pivots with respect to the case 380 at the pin 384. Once again, tensioning of the interior triggering cable 46 releases the hammer assembly 62 (FIG. 1B) which in turns fires the firing assembly 64 (FIG. 1B), activates the cylinder assembly 60 (FIG. 1B) and finally the lift assembly 58 (FIG. 1B).

Alternative Embodiment

Figure 8A:
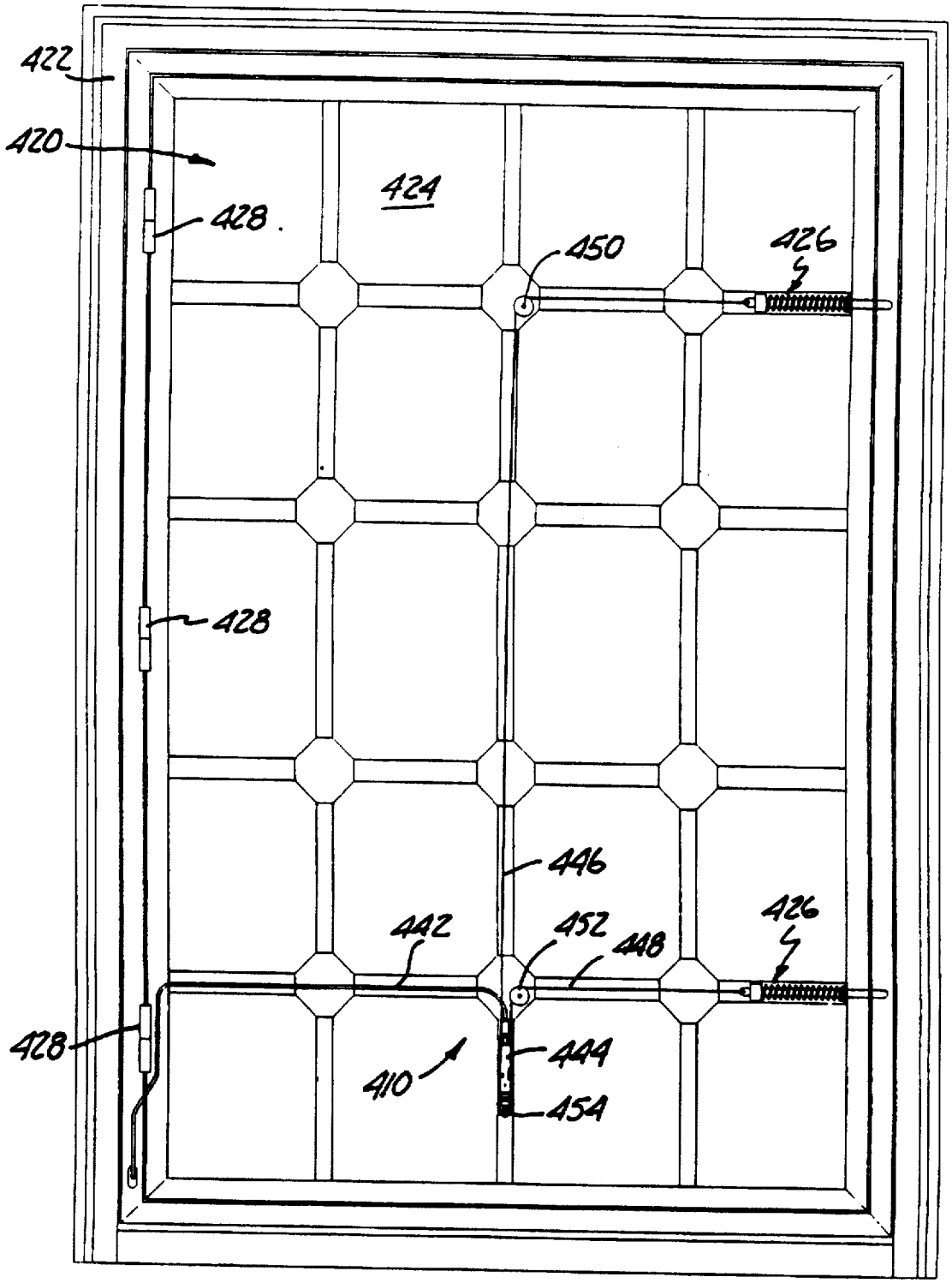
FIG. 8A is a front view of an alternative embodiment.
Figure 8B:
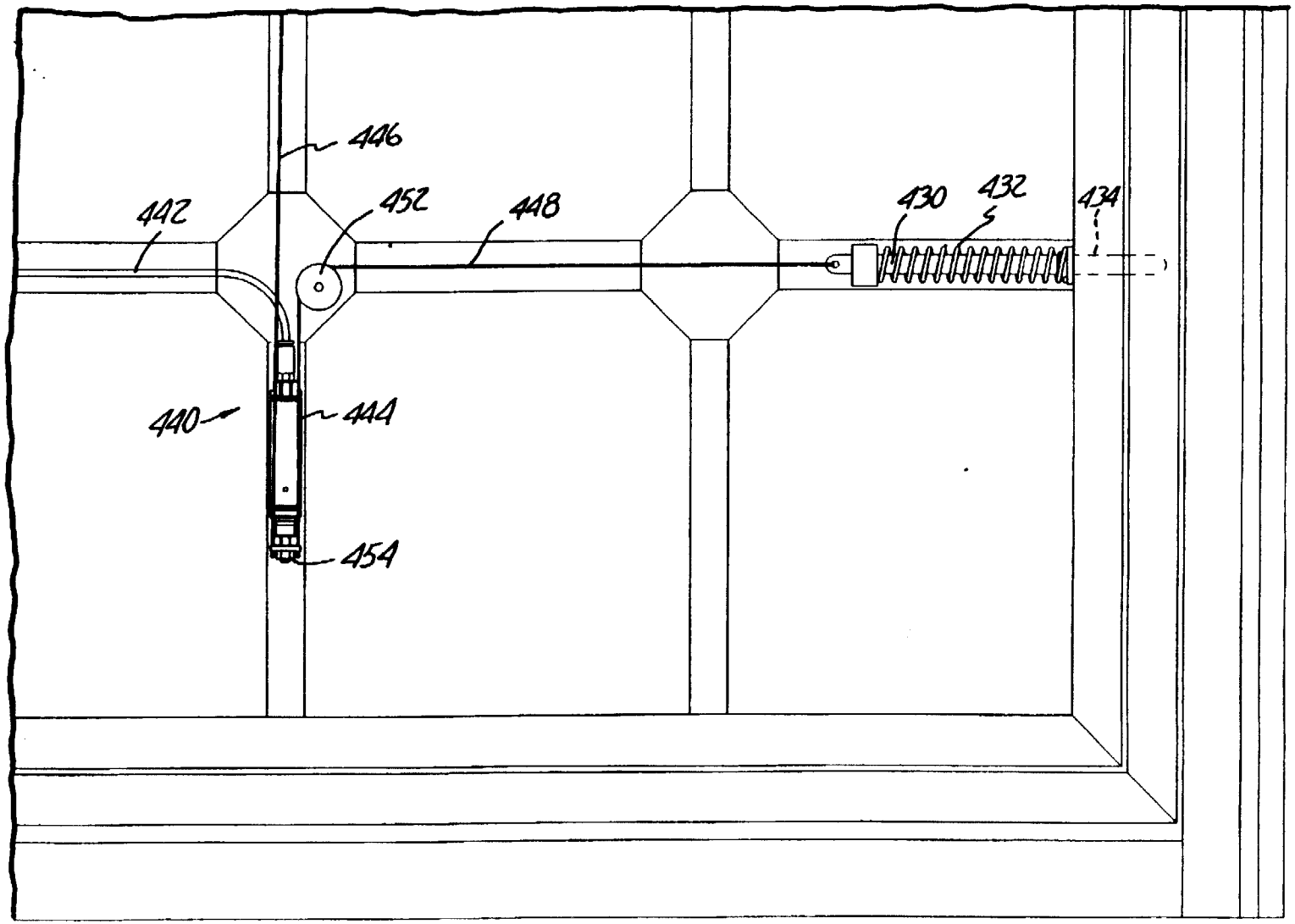
FIG. 8B is an enlarged front view of the alternative embodiment shown in FIG. 8A.

FIGS. 8A and 8B provide an alternative embodiment of the present invention. FIG. 8A depicts portions of a window propelling system 440 as applied to a security window 420. FIG. 8B is an enlarged view of a portion of the window propelling system 440.

The security window 420 includes a frame 422, a reinforced window 424 and locking mechanisms 426. The reinforced window 424 is attached to the frame 422 by hinges 428. The locking mechanisms 426 include a shaft 430, a spring 432 and a bolt end 434. The spring 432 biases the bolt end 434 into a receiving portion in the frame 422 to lock the reinforced window 424 to the frame 422.

The window propelling system 440 shown in FIG. 8A and 8B is powered by the firing assembly 64 (FIG. 1B) as previously described. However, the lift assembly 58 (FIG. 1B) and the cylinder assembly 60 (FIG. 1B) have been reconstructed. In particular, the window propelling system 440 includes a transmission line 442, a cylinder 444, a first cable 446, a second cable 448, a first pulley 450 and second pulley 452. The first cable 446 extends from a head portion 454 of the cylinder 444 around the first pulley 450 and is attached to one of the locking mechanisms 426. Similarly, the second cable 448 extends from the head portion 454 of the cylinder 444, extends around the second pulley 452 and attaches to the other of the locking mechanisms 426.

As previously described, upon activation, forced fluid is transferred via the transmission line 442 to the cylinder 444. The forced fluid forces the head 454 away from the cylinder 444. This action, in turn, tensions the first cable 446 and the second cable 448 with a pulling force greater than the tension within the springs 426. The first cable 446 and the second cable 448 retract the bolt ends 434 of the blocking mechanisms 426. In the retracted position, the reinforced window 424 can be opened with respect to the frame 422 by movement on the hinges 428.

Conclusion

The window propelling system of the present invention provides a unique assembly for opening windows or doors, which is easily installed to existing window assemblies. The window propelling system does not require electricity and allows for normal, traditional opening and closing of a window or door. The lift assembly, cylinder assembly and trigger combine to afford quick opening of a window or door in emergency situations. The hammer assembly and firing assembly are specifically designed to allow repeated use of the window propelling system by simply pulling the cocking lanyard and inserting a new pressurized fluid supply. Finally, the secondary trigger assembly is designed to afford emergency workers access to the home in case of fire. The window propelling system can also be modified to include additional features, such as a screen release assembly which pushes a window screen away from the window in response to activation of the cylinder assembly.

Although the present invention has been described with reference to preferred embodiments, workers skilled in the art will recognize that changes may be made in form and detail without departing from the spirit and scope of the invention. For example, the window propelling system has been described as preferably including the secondary trigger assembly. However, this feature is not required for functioning of the window propelling system. In other words, a user will be able to propel the window open in an emergency by simply activating the interior trigger. Similarly, the window unlock assembly is an additional feature not necessarily required.

Also, the preferred embodiment includes both the piston cable and the takeup cable, which are attached to one another. However, the piston cable and takeup cable can be replaced by a single cable, extending from the lift cable equalizer pulley, through the cylinder assembly, and to the free takeup pulley block.

The interior trigger has been described as preferably being located below the window assembly. This is for convenience to a user. Alternatively, the trigger can be positioned at various locations with respect to the window assembly, and can be replaced by a switch, button, etc.

Finally, the various components have been preferably described as being made from stainless steel. Other rigid materials, such as aluminum, copper, etc. are equally acceptable.

What is claimed is:

1. An emergency window propelling system, the system comprising:

a lift cable system for attachment to a window;

uni-directional forced fluid motion means to operate the lift cable system to propel open the window to which the lift cable system is attached; and coupling means connecting the lift cable system to the forced fluid motion means when the window to which the lift cable system is attached is closed to permit the forced fluid motion means to propel the window open, the coupling means disconnecting the lift cable system from the forced fluid motion means to permit manual opening and closing of the window.

2. An emergency window propelling system, the system comprising:

a lift cable system for attachment to a window;

uni-directional forced fluid motion means to operate the lift cable system to propel open the window to which the lift cable system is attached; and coupling means conecting the lift cable system to the forced fluid motion means, the coupling means being responsive to operation of the forced fluid motion means to transfer force from the forced fluid motion means to the lift cable system to propel nopen the window, the coupling means being responsive to operation of the lift cable system due to manual opening and closing of the window to permit manual opening and closing of the window without operating the forced fluid motion means.

* * * * *

UNITED STATES PATENT AND TRADEMARK OFFICE

CERTIFICATE OF CORRECTION

PATENT NO. : 5,784,831

DATED : JULY 28, 1998

INVENTOR(S) : MICHAEL A. LICKING

It is certified that error appears in the above-identified patent and that said Letters Patent is hereby corrected as shown below:

Col. 11, line 59, delete "body248", insert --body 248--

Col. 11, line 64, delete "block224", insert --block 224 --

Col. 18, line 32, delete "conecting", insert --connecting--

Col. 18, line 36, delete "nopen", insert –open–

Signed and Sealed this

Fifteenth Day of June, 1999

*Attest:*

Q. TODD DICKINSON

*Attesting Officer*

*Acting Commissioner of Patents and Trademarks*